US006187056B1

(12) United States Patent
Terziev

(10) Patent No.: US 6,187,056 B1
(45) **Date of Patent: *Feb. 13, 2001**

(54) METHOD OF REMOVING GREASE AND OIL FROM DRY CLOTHING USING POWDER CONTAINING CLAY AND TALC

(76) Inventor: Nicola Terziev, 5100 N.Ocean Blvd., #1407, Fort Lauderdale, FL (US) 33308

( * ) Notice: Under 35 U.S.C. 154(b), the term of this patent shall be extended for 0 days.

This patent is subject to a terminal disclaimer.

(21) Appl. No.: 09/497,785

(22) Filed: Feb. 3, 2000

(51) Int. Cl.[7] ..... D06L 1/00; C11D 7/02; C11D 7/20

(52) U.S. Cl. ..... 8/137; 510/285; 510/445; 510/446; 510/507; 510/511; 510/516

(58) Field of Search ..... 510/285, 445, 510/446, 507, 511, 516; 8/137

(56) References Cited

U.S. PATENT DOCUMENTS

| | | | | |
|---|---|---|---|---|
| 4,076,633 | * | 2/1978 | Edwards et al. | 252/8.75 |
| 4,178,254 | * | 12/1979 | Leikhim et al. | 252/8.6 |
| 4,493,781 | * | 1/1985 | Chapman et al. | 252/88 |
| 5,990,075 | * | 11/1999 | Terziev | 510/507 |

* cited by examiner

*Primary Examiner*—Gregory R. DelCotto

(57) ABSTRACT

A method of removing a spot of grease and oil from soiled, dry, clothing includes applying a cleaner, in powdered form, to the dry clothing. The cleaner contains a mixture of clay and talc mixed in a ratio. The ratio is a function of the nature of the spot.

5 Claims, No Drawings

METHOD OF REMOVING GREASE AND OIL FROM DRY CLOTHING USING POWDER CONTAINING CLAY AND TALC

CROSS-REFERENCE TO RELATED APPLICATIONS

This patent is an improvement over my prior patent, U.S. Pat. No. 5,990,075, issued Nov. 23, 1999.

STATEMENT REGARDING FEDERALLY SPONSORED RESEARCH OR DEVELOPMENT

Not applicable.

BACKGROUND OF THE INVENTION

This invention is designed for easy dry cleaning of greasy spots which appear on clothes after meals, cooking, etc. It is an improvement over my earlier patent, U.S. Pat. No. 5,990,075.

The following problem exists at the present. After meals people often get greasy spots on their garments. These stubborn oily stains cannot be easily removed either by conventional laudry or dry cleaning. Frequently such stains ar still visible on the fabric even after professional dry cleaning, which is costly and time-consuming. Some oily stains can cause a permanent damage to clothes after it has been washed once.

Presently existing products on the market for spot removal are liquid-based. When applied on the spot, they leave a rim around the spot, causing permanent damage to the garment.

BRIEF SUMMARY OF THE INVENTION

This invention is designed to extract grease from spots which appear on clothes after meals or after handling oil products. When used properly, the product absorbs oils from dry fabrics, leaving them clean and rim-free.

The product, in the preferred embodiment, is a combination of two components: powdered white montmorillonite clay and powdered talc. Both minerals belong to a phyllosilicate group and have high absorbing properties, which makes them ideally suited for the purpose of oil exraction.

Montmorillonite [$Al_4(Si_4O_{10})_{2x}nH_2O$, hydrated aluminum silicate] is an abundant clay formed by weathering in many warm climates. It is also the main clay product of the weathering of volcanic ash. It has the structure and cation composition that gives it the ability to absorb large quantities of liquid, which spreads the layers apart and makes them easily cleavable. Montmorillonite has the highest absorption ability of all clays.

Talc ($Mg_3(Si_2O_5)_2(OH)_2$, hydrous magnesium silicate] is an alteration product of magnesium silicates in ultramafic rocks, common in regionally metamorphosed rocks (schists). It is also formed by metasomatism in impure dolomitic marbles. It has a layered structure, in which the layers are electrically neutral. The attractive forces between them are consequently feeble, and the mineral cleaves readily.

Experiments indicate that the above minerals give the best performance when mixed in a ratio of about 2 parts talc to about 1 part clay for the preferred embodiment.

The invention has several advantages.

It is extremely effective in removing grease spots from any fabric.

It is non-toxic, contains no environmental pollutants or hazardous materials.

It is easy and safe for use at home.

It will save time and money to the consumer.

DETAILED DESCRIPTION OF THE INVENTION

Oil is a non-polar substance. Like dissolves like in chemistry; therefore, oil cannot be dissolved with a polar substance such as water. Even addition of soap to water frequently gives poor results when used to remove an oil strain. Additionally, not all fabrics can be washed in water.

An alternative method has been designed to overcome this problem. Since oil can be extracted from fabric, a mixture of the two non-polar substances acts as an absorbent. The mixture is dry, making it safe to use even on fabrics that cannot undergo a conventional laundry. The mixture contains a powdered white montmorillonite clay and powered talc mixed in a 1:2 ratio, which has been experimentally established. Experiments showed that neither of the minerals gave a 100% satisfactory result when used alone. Clay was best in absorption of lighter oils, while talc showed better results in absorption of heavier oils. Thus absorption properties of one mineral were complemented by the addition of another, and together they were capable of absorbing a wider variety of oils and grease. Following is the explanation of the absorption properties of both minerals.

CLAY: The major structure of colloidal clay particles is that of layers or flakes. The individual size and shape of the laminations is largely determined by the developmental conditions and the type of mineral concerned. This plate-like structure and finely divided state gives clays a very large specific surface area; for example, the external surface area of 1 g colloidal clay is approximately 1000 times that of 1 g course sand. This large surface area is of a great importance for the absorption properties of clays.

All clay minerals have the basic structures of sheet silicates; sheets of silica tetrahedra alternate with sheets of alumina octahedra. Clay minerals are groups into two categories depending on the layer structure. Group 1 minerals (kaolinite) are built from three sheets—one hexagonal and two complete sheets. Group 2 minerals (micaceous clays, vermicules and montmorillonites) have symmetrical structures of two complete sheets sandwiched between hexagonal sheets. Group 1 minerals have a rigid overall lattice structure held together by weak hydroxyl bonds, which prevents water and cations from entering between the structural units. This, coupled with a small negative charge, is one of the reasons for the low absorption capacity of kaolinite, which makes it useful for manufacturing of pottery and ceramics, but less valuable as an absorbent.

Group 2 minerals have crystal units that are held one to another by electrostatic interactions between surface negative charges in the outer sheets of one unit and the positive charges in sheets of other crystal units. In micaceous clays and vermicule clays the force of attraction between crystal units can be strong, which adversely affects their absorption properties. In montmorillonite $Al_4(Si_4O_{10})_{2x}nH_2O$, there are no hydroxyl bonds available on the outside of the layers. The absence of hydroxyl bonding between the oxygen anions in adjacent units means that the units can be easily separated, making it easy for the mineral structure to expend, allowing water, cations or oil to move between the crystal units. Thus, the area exposed for cation exchange is greatly increased, making montmorillonite a good absorbent of water and oil. Montmorillonite has about 10 to 15 times the cation absorption capacity of kaolinite. For example, 1 kg of montmorillonite can accommodate 2.5 liters of water and still not be liquid in comparison with 1 kg of kaolinite, which turns into liquid after the addition of only 1.4 liters of water.

TALC: Talc $[Mg_3(Si_2O_5)_2(OH)_2]$ belongs to a class of phyllosilicates with layer structures which contain sheets of six-membered rings of tetrahedra in which the tetrahedra all point the same way. The dimensions of the $SiO_4$ tetrahedra are such that the O—O spacing between oxygen at the peaks of the tetrahedra is very nearly the same as the O—O spacing between adjacent oxygen on a $MgO_6$ octahedron. In talc the layer of $MgO_6$ octahedra is sandwiched between two sheets of $SiO_4$ tetrahedra in six-membered rings. Silicon-oxygen sheets are formed by sharing of oxygen atoms between double chains. These ionic bonds are weaker than the silicon bonds between the sheets, and sandwich layers are essentially uncharged and held together only by Van der Waals forces. This explains why talc is an extremely soft and smooth mineral which cleaves easily into thin layers. This property along with low moisture content gives talc its ability to absorb oil and grease. Talc's structure provides its chemical inertness, which is also important, because it will help to avoid discoloration when the product is applied on fabrics.

The Montmorillonite/Smectite Group

This group is composed of several minerals including pyrophyllite, talc, vermiculite, sauconite, saponite, nontronite, and montmorillonite. They differ mostly in chemical content. The general formula is (Ca, Na, H) (Al, Mg, Fe, Zn)$_2$ (Si, Al)$_4O_{10}(OH)_2$—$xH_2O$, where x represents the variable amount of water that members of this group could contain. Talc's formula, for example, is $Mg_3Si_4O_{10}(OH)_2$. The gibbsite layers of the kaolinite group can be replaced in this group by a similar layer that is analogous to the oxide brucite, $(Mg_2(OH)_4)$. The structure of this group is composed of silicate layers sandwiching a gibbsite (or brucite) layer in between, in an s-g-s stacking sequence. The variable amounts of water molecules would lie between the s-g-s sandwiches.

Smectite refers to a family of non-metallic clays primarily composed of hydrated sodium calcium aluminum silicate. Common names for smectite include montmorillonite or sodium montmorillonite ("sodium bentonite" or "Wyoming bentonite") and swelling bentonite ("Western betonite"). Smectite is a clay mineral having a 2:1 expanding crystal lattice. Its isomorphous substitution gives the various types of smectite and causes a net permanent charge balanced by cations in such a manner that water may move between the sheets of the crystal lattice, giving a reversible cation exchange and very plastic properties. Smectite is used to slow the progress of water through soil or rocks; used in drilling mud to give the water greater viscosity; used to produce nanocomposites; used as an absorbent to purify and decolor liquids; used as filler in paper and rubber; and used as a base for cosmetics and medicines.

Properties of Smectite Clays

High Durability

Smectite clays are robust minerals that do not readily degrade and are thus well suited for practical applications.

Cation-exchange Properties

Isomorphous substitutions create an excess negative charge on the clay structure, which imparts cation-exchange properties.

Acid-base Properties

A variety of surface functionalities (e.g., surface silanol groups) enable smectite clays to participate in both Bronsted and Lewis acid-base reactions, depending upon the conditions of the clay.

Absorption of Organic Molecules

A variety of organic molecules absorb, to varying degrees, on the clay surface.

Incorporation of Cationic Catalysts into Clay Colloids

Smectite clays possess cation-exchange properties, whic provide an attractive method for incorporation of cationic compounds into clay particles.

Introduction of cationic complexes, particularly large, hydrophobic molecules, into a clay colloid produces immediate flocculation. Flocculation appears to result from the simultaneous adsorption of a complex on two clay particles, thereby binding the particles together. Compounds trapped within the flocculated clay are inaccessible for reaction with dissolved substrates. Smectite clays are layered silicates of high surface area, high cation exchange capacity, and high surface acidity. As a result they are desirable as adsorbents. Smectites are especially useful because their interlayer is capable of swelling rather easily, and can therefore incorporate an array of molecules ranging from organics to organometallics to inorganic complexes.

For example, the method of removing a spot of grease and oil from soiled, dry, clothing includes applying a cleaner, in powder form, to the dry clothing. The cleaner contains a mixture of clay, preferably montmorillonite clay, and talc in a ratio. The ratio is a function of the nature of the spot. The preferred ratio for removing a wide variety of spots is about one part clay and about two parts talc.

As a further example, the method of removing a spot of grease and oil from soiled, dry, clothing includes applying a cleaner, in powder form to the dry clothing. The mixture contains clay and talc in a ratio. The clay is selected from the class of clays having electrostatic interactions between surface negative charges in the outer sheets of one unit and the positive charges in sheets of the other crystal units, including montmorillonite clay, micaceous clay, and vermicule clay.

As a further example, for removing types of spots with heavy oils and fats, such as olive oil and animal fats, the method of removing a spot of grease and oil from soiled, dry, clothing includes applying a cleaner, in powder form, to the dry clothing. The cleaner contains clay and talc mixed in a ratio of at least one part clay or greater and nine parts talc or less.

In yet another example, for removing types of spots with light oils and fats, such as vegatable oils, the method of removing a spot of grease and oil from soiled, dry, clothing includes applying a cleaner, in powder form, to the dry clothing. The cleaner contains clay and talc mixed in a ratio of at least nine parts clay or less and one part talc or greater.

As a final example and as an alternate embodiment of the invention, the method of removing a spot of grease and oil from soiled, dry, clothing includes applying a cleaner, in powder form, containing a mixture of clay and talc wherein the clay and talc are mixed in a ratio, which is a function of the nature of the spot, to the dry clothing. The mixture further contains less than one percent of a fragrance.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A method of removing a spot of grease and oil from soiled, dry, clothing wherein said method comprises applying a cleaner, in dry powder form, comprising a mixture of clay and talc wherein said clay and said talc are in a ratio of about 1:9 to 9:2, which is a function of the nature of the spot, to the dry clothing.

2. The method as set forth in claim 1 wherein the clay is montmorillonite clay.

3. The method as set forth in claim 1 wherein the clay is selected from the group consisting of montmorillonite clay, micaceous clay, and vermicule clay.

4. The method as set forth in claim 1 wherein the clay and talc are mixed in a ratio of about one part clay and about two parts talc for removing a wide variety of spots.

5. The method as set forth in claim 1 wherein the cleaner further comprises less than one percent of a fragrance as part of the mixture.

* * * * *